US007474319B2

(12) United States Patent
Allen et al.

(10) Patent No.: US 7,474,319 B2
(45) Date of Patent: Jan. 6, 2009

(54) GENERATING AND DISPLAYING SPATIALLY OFFSET SUB-FRAMES

(75) Inventors: William J. Allen, Corvallis, OR (US); Paul J. McClellan, Bend, OR (US); David C. Collins, Philomath, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 792 days.

(21) Appl. No.: 10/969,747

(22) Filed: Oct. 20, 2004

(65) Prior Publication Data

US 2006/0082561 A1 Apr. 20, 2006

(51) Int. Cl.
*G09G 5/02* (2006.01)

(52) U.S. Cl. ..... 345/694; 345/696; 345/698

(58) Field of Classification Search ..... 345/690–693, 345/87, 98, 100, 204, 694, 696
See application file for complete search history.

(56) References Cited

U.S. PATENT DOCUMENTS

| | | | | |
|---|---|---|---|---|
| 4,373,784 | A | 2/1983 | Nonomura et al. | |
| 4,662,746 | A | 5/1987 | Hornbeck | |
| 4,769,635 | A * | 9/1988 | Ishizaka | 345/10 |
| 4,811,003 | A | 3/1989 | Strathman et al. | |
| 4,956,619 | A | 9/1990 | Hornbeck | |
| 5,061,049 | A | 10/1991 | Hornbeck | |
| 5,083,857 | A | 1/1992 | Hornbeck | |
| 5,146,356 | A | 9/1992 | Carlson | |
| 5,298,915 | A * | 3/1994 | Bassetti, Jr. | 345/696 |
| 5,317,409 | A | 5/1994 | Macocs | |
| 5,386,253 | A | 1/1995 | Fielding | |
| 5,490,009 | A | 2/1996 | Venkateswar et al. | |
| 5,530,482 | A | 6/1996 | Gove et al. | |
| 5,557,353 | A | 9/1996 | Stahl | |
| 5,689,283 | A | 11/1997 | Shirochi | |
| 5,729,245 | A | 3/1998 | Gove et al. | |
| 5,742,274 | A | 4/1998 | Henry et al. | |
| 5,757,355 | A | 5/1998 | Ogura et al. | |
| 5,912,773 | A | 6/1999 | Barnett et al. | |
| 5,920,365 | A | 7/1999 | Eriksson | |
| 5,953,148 | A | 9/1999 | Moseley et al. | |

(Continued)

FOREIGN PATENT DOCUMENTS

| | | | |
|---|---|---|---|
| EP | 0 790 514 | A | 8/1997 |

(Continued)

OTHER PUBLICATIONS

L.M. Chen and S. Hasagawa, "Visual Resolution Limits for Color Matrix Displays", "One Panel Projectors" Displays, Technologies, and Applications, vol. 13, pp. 221-226, 1992.

(Continued)

*Primary Examiner*—Kevin M Nguyen

(57) ABSTRACT

A display device for displaying an image using a first sub-frame and a second sub-frame is provided. The display device comprises an array having a first plurality of pixels and a second plurality of pixels offset from but overlapping the first plurality of pixels and a control unit. The control unit is configured to cause the array to display the first sub-frame using the first plurality of pixels, and the control unit is configured to cause the array to display the second sub-frame using the second plurality of pixels.

30 Claims, 8 Drawing Sheets

U.S. PATENT DOCUMENTS

| | | | | |
|---|---|---|---|---|
| 5,978,518 | A | 11/1999 | Oliyide et al. | |
| 6,025,951 | A | 2/2000 | Swart et al. | |
| 6,067,143 | A | 5/2000 | Tomita | |
| 6,104,375 | A | 8/2000 | Lam | |
| 6,118,584 | A | 9/2000 | Van Berkel et al. | |
| 6,141,039 | A | 10/2000 | Poetsch | |
| 6,184,969 | B1 | 2/2001 | Fergason | |
| 6,219,017 | B1 | 4/2001 | Shimada et al. | |
| 6,239,783 | B1 | 5/2001 | Hill et al. | |
| 6,243,055 | B1 | 6/2001 | Fergason | |
| 6,313,888 | B1 | 11/2001 | Tabata | |
| 6,329,974 | B1 * | 12/2001 | Walker et al. | 345/98 |
| 6,384,816 | B1 | 5/2002 | Tabata | |
| 6,393,145 | B2 | 5/2002 | Betrisey et al. | |
| 6,414,657 | B1 * | 7/2002 | Kasahara et al. | 345/690 |
| 6,522,356 | B1 | 2/2003 | Watanabe | |
| 6,657,603 | B1 | 12/2003 | Demetrescu et al. | |
| 6,825,835 | B2 | 11/2004 | Sano et al. | |
| 7,227,521 | B2 * | 6/2007 | Yamazaki et al. | 345/84 |
| 7,307,646 | B2 * | 12/2007 | Brown Elliott | 345/694 |
| 2003/0011614 | A1 | 1/2003 | Itoh et al. | |
| 2003/0020809 | A1 | 1/2003 | Gibbon et al. | |
| 2003/0076325 | A1 | 4/2003 | Thrasher | |
| 2003/0090597 | A1 | 5/2003 | Katoh et al. | |
| 2003/0133060 | A1 | 7/2003 | Shimada | |

FOREIGN PATENT DOCUMENTS

| | | | |
|---|---|---|---|
| EP | 1001306 | A2 | 5/2000 |
| EP | 1 388 838 | A | 2/2004 |
| JP | 06-038246 | A | 5/1994 |

OTHER PUBLICATIONS

A. Yasuda et al., "FLC Wobbling for High-Resolution Projectors", Journal of the SID May 3, 1997, pp. 299-305.

T. Tokita et al., "P-108: FLC Resolution-Enhancing Device for Projection Displays", SID 02 Digest 2002, pp. 638-641.

D.H. Kelly, "Motion and Vision—II. Stabilized Spatio-Temporal Threshold Surface," Journal of the Optical Society of America, vol. 69, No. 10, Oct. 1979.

Candice H. Brown Elliot et al., "Color Subpixel Rendering Projectors and Flat Panel Displays" SMPTE Advanced Motion Imaging Conference; Feb. 27-Mar. 1, 2003, pp. 1-4.

Diana C. Chen, "Display Resolution Enhancement with Optical Scanners" Applied Optics, vol. 40, No. 5, Feb. 10, 2001, pp. 636-643.

* cited by examiner

GENERATING AND DISPLAYING SPATIALLY OFFSET SUB-FRAMES

CROSS-REFERENCE TO RELATED APPLICATIONS

This application is related to U.S. patent application Ser. No. 10/213,555, filed on Aug. 7, 2002, entitled IMAGE DISPLAY SYSTEM AND METHOD; U.S. patent application Ser. No. 10/242,195, filed on Sep. 11, 2002, entitled IMAGE DISPLAY SYSTEM AND METHOD; U.S. patent application Ser. No. 10/242,545, filed on Sep. 11, 2002, entitled IMAGE DISPLAY SYSTEM AND METHOD; U.S. patent application Ser. No. 10/631,681, filed Jul. 31, 2003, entitled GENERATING AND DISPLAYING SPATIALLY OFFSET SUB-FRAMES; U.S. patent application Ser. No. 10/632,042, filed Jul. 31, 2003, entitled GENERATING AND DISPLAYING SPATIALLY OFFSET SUB-FRAMES; U.S. patent application Ser. No. 10/672,845, filed Sep. 26, 2003, entitled GENERATING AND DISPLAYING SPATIALLY OFFSET SUB-FRAMES; U.S. patent application Ser. No. 10/672,544, filed Sep. 26, 2003, entitled GENERATING AND DISPLAYING SPATIALLY OFFSET SUB-FRAMES; U.S. patent application Ser. No. 10/697,605, filed Oct. 30, 2003, entitled GENERATING AND DISPLAYING SPATIALLY OFFSET SUB-FRAMES ON A DIAMOND GRID; U.S. patent application Ser. No. 10/696,888, filed Oct. 30, 2003, entitled GENERATING AND DISPLAYING SPATIALLY OFFSET SUB-FRAMES ON DIFFERENT TYPES OF GRIDS; U.S. patent application Ser. No. 10/697,830, filed Oct. 30, 2003, entitled IMAGE DISPLAY SYSTEM AND METHOD; U.S. patent application Ser. No. 10/750,591, filed Dec. 31, 2003, entitled DISPLAYING SPATIALLY OFFSET SUB-FRAMES WITH A DISPLAY DEVICE HAVING A SET OF DEFECTIVE DISPLAY PIXELS; U.S. patent application Ser. No. 10/768,621, filed Jan. 30, 2004, entitled GENERATING AND DISPLAYING SPATIALLY OFFSET SUB-FRAMES; U.S. patent application Ser. No. 10/768,215, filed Jan. 30, 2004, entitled DISPLAYING SUB-FRAMES AT SPATIALLY OFFSET POSITIONS ON A CIRCLE; U.S. patent application Ser. No. 10/821,135, filed Apr. 8, 2004, entitled GENERATING AND DISPLAYING SPATIALLY OFFSET SUB-FRAMES; U.S. patent application Ser. No. 10/821,130, filed Apr. 8, 2004, entitled GENERATING AND DISPLAYING SPATIALLY OFFSET SUB-FRAMES; U.S. patent application Ser. No. 10/820,952, filed Apr. 8, 2004, entitled GENERATING AND DISPLAYING SPATIALLY OFFSET SUB-FRAMES; U.S. patent application Ser. No. 10/864,125, filed Jun. 9, 2004, entitled GENERATING AND DISPLAYING SPATIALLY OFFSET SUB-FRAMES; U.S. patent application Ser. No. 10/868,719, filed Jun. 15, 2004, entitled GENERATING AND DISPLAYING SPATIALLY OFFSET SUB-FRAMES, and U.S. patent application Ser. No. 10/868,638, filed Jun. 15, 2004, entitled GENERATING AND DISPLAYING SPATIALLY OFFSET SUB-FRAMES. Each of the above U.S. patent applications is assigned to the assignee of the present invention, and is hereby incorporated by reference herein.

BACKGROUND

A conventional system or device for displaying an image, such as a display, projector, or other imaging system, produces a displayed image by addressing an array of individual picture elements or pixels arranged in horizontal rows and vertical columns. A resolution of the displayed image is defined as the number of horizontal rows and vertical columns of individual pixels forming the displayed image. The resolution of the displayed image is affected by a resolution of the display device itself as well as a resolution of the image data processed by the display device and used to produce the displayed image.

Typically, to increase a resolution of the displayed image, the resolution of the display device as well as the resolution of the image data used to produce the displayed image needs to be increased. Increasing a resolution of the display device, however, increases a cost and complexity of the display device. Higher resolution data may also require a significantly higher bandwidth if the display data must be conveyed from a processing unit, where the display data is generated, to the display device itself. For example, doubling the linear resolution of a display typically results in a four-fold increase in the amount of data per image.

At times, certain display techniques may be used to increase the resolution of various types of graphical images. Display devices, however, may not include specialized components that would most efficiently implement these techniques. It would be desirable to be able to operate one or more components of a display device in ways suited for a display technique.

SUMMARY

One form of the present invention provides a display device for displaying an image using a first sub-frame and a second sub-frame. The display device comprises an array having a first plurality of pixels and a second plurality of pixels offset from but overlapping the first plurality of pixels and a control unit. The control unit is configured to cause the array to display the first sub-frame using the first plurality of pixels, and the control unit is configured to cause the array to display the second sub-frame using the second plurality of pixels.

DETAILED DESCRIPTION

In the following detailed description of the preferred embodiments, reference is made to the accompanying drawings, which form a part hereof, and in which is shown by way of illustration specific embodiments in which the invention may be practiced. It is to be understood that other embodiments may be utilized and structural or logical changes may be made without departing from the scope of the present invention. The following detailed description, therefore, is not to be taken in a limiting sense, and the scope of the present invention is defined by the appended claims.

I. Spatial and Temporal Shifting of Sub-Frames

Some display systems, such as some digital light projectors, may not have sufficient resolution to display some high resolution images. Such systems can be configured to give the appearance to the human eye of higher resolution images by displaying spatially and temporally shifted lower resolution images. The lower resolution images are referred to as sub-frames. A problem of sub-frame generation, which is addressed by embodiments of the present invention, is to determine appropriate values for the sub-frames so that the displayed sub-frames are close in appearance to how the high-resolution image from which the sub-frames were derived would appear if directly displayed.

One embodiment of a display system that provides the appearance of enhanced resolution through temporal and spatial shifting of sub-frames is described in the U.S. patent applications cited above, and is summarized below with reference to FIGS. 1-4E.

Figure 1:
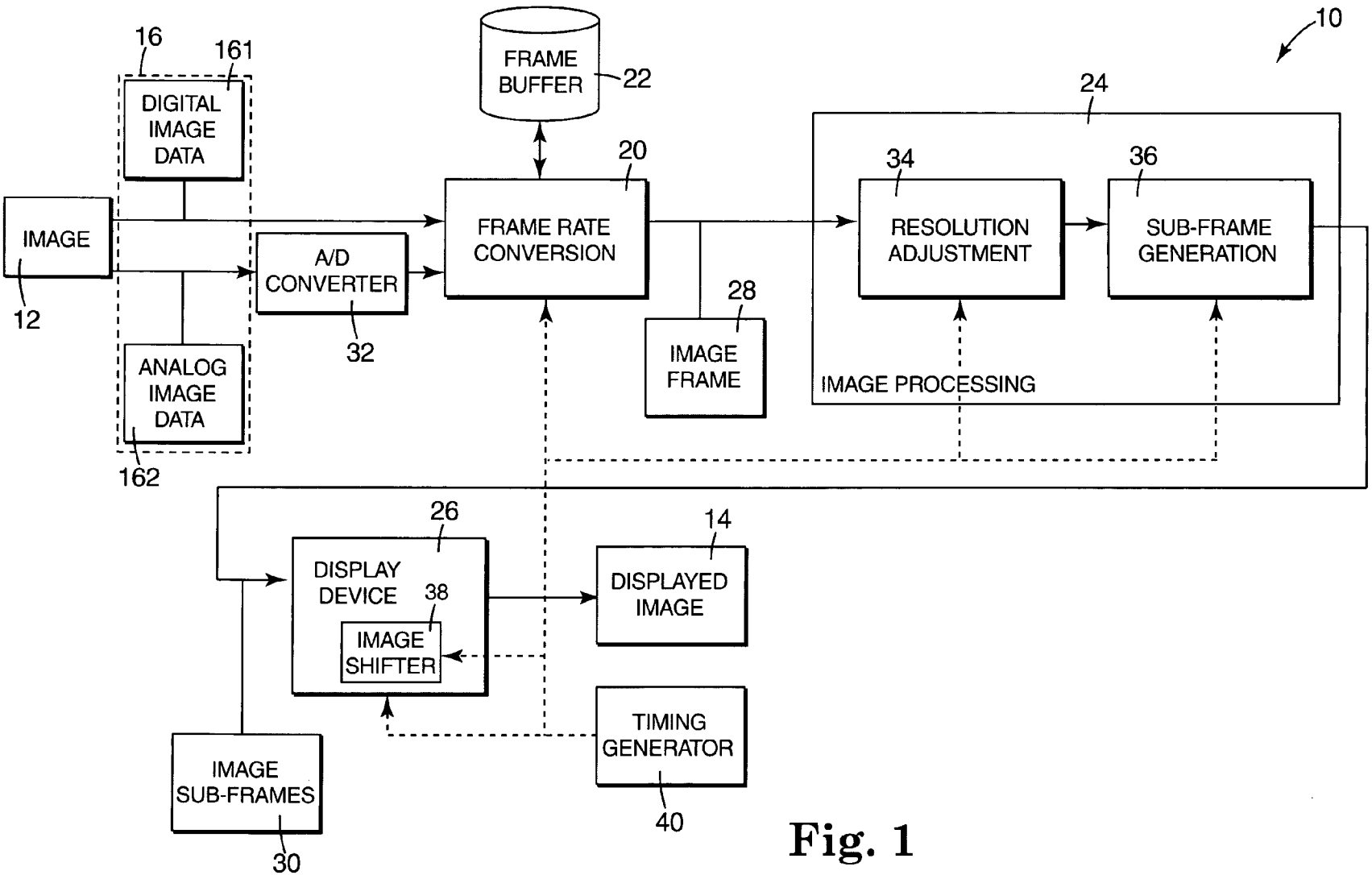
FIG. 1 is a block diagram illustrating an image display system according to one embodiment of the present invention.

FIG. 1 is a block diagram illustrating an image display system 10 according to one embodiment of the present invention. Image display system 10 facilitates processing of an image 12 to create a displayed image 14. Image 12 is defined to include any pictorial, graphical, and/or textural characters, symbols, illustrations, and/or other representation of information. Image 12 is represented, for example, by image data 16. Image data 16 includes individual picture elements or pixels of image 12. While one image is illustrated and described as being processed by image display system 10, it is understood that a plurality or series of images may be processed and displayed by image display system 10.

In one embodiment, image display system 10 includes a frame rate conversion unit 20 and an image frame buffer 22, an image processing unit 24, and a display device 26. As described below, frame rate conversion unit 20 and image frame buffer 22 receive and buffer image data 16 for image 12 to create an image frame 28 for image 12. Image processing unit 24 processes image frame 28 to define one or more image sub-frames 30 for image frame 28, and display device 26 temporally and spatially displays image sub-frames 30 to produce displayed image 14.

Image display system 10, including frame rate conversion unit 20 and/or image processing unit 24, includes hardware, software, firmware, or a combination of these. In one embodiment, one or more components of image display system 10, including frame rate conversion unit 20 and/or image processing unit 24, are included in a computer, computer server, or other microprocessor-based system capable of performing a sequence of logic operations. In addition, processing can be distributed throughout the system with individual portions being implemented in separate system components.

Image data 16 may include digital image data 161 or analog image data 162. To process analog image data 162, image display system 10 includes an analog-to-digital (A/D) converter 32. As such, A/D converter 32 converts analog image data 162 to digital form for subsequent processing. Thus, image display system 10 may receive and process digital image data 161 and/or analog image data 162 for image 12.

Frame rate conversion unit 20 receives image data 16 for image 12 and buffers or stores image data 16 in image frame buffer 22. More specifically, frame rate conversion unit 20 receives image data 16 representing individual lines or fields of image 12 and buffers image data 16 in image frame buffer 22 to create image frame 28 for image 12. Image frame buffer 22 buffers image data 16 by receiving and storing all of the image data for image frame 28, and frame rate conversion unit 20 creates image frame 28 by subsequently retrieving or extracting all of the image data for image frame 28 from image frame buffer 22. As such, image frame 28 is defined to include a plurality of individual lines or fields of image data 16 representing an entirety of image 12. Thus, image frame 28 includes a plurality of columns and a plurality of rows of individual pixels representing image 12.

Frame rate conversion unit 20 and image frame buffer 22 can receive and process image data 16 as progressive image data and/or interlaced image data. With progressive image data, frame rate conversion unit 20 and image frame buffer 22 receive and store sequential fields of image data 16 for image 12. Thus, frame rate conversion unit 20 creates image frame 28 by retrieving the sequential fields of image data 16 for image 12. With interlaced image data, frame rate conversion unit 20 and image frame buffer 22 receive and store odd fields and even fields of image data 16 for image 12. For example, all of the odd fields of image data 16 are received and stored and all of the even fields of image data 16 are received and stored. As such, frame rate conversion unit 20 de-interlaces image data 16 and creates image frame 28 by retrieving the odd and even fields of image data 16 for image 12.

Image frame buffer 22 includes memory for storing image data 16 for one or more image frames 28 of respective images 12. Thus, image frame buffer 22 constitutes a database of one or more image frames 28. Examples of image frame buffer 22 include non-volatile memory (e.g., a hard disk drive or other persistent storage device) and may include volatile memory (e.g., random access memory (RAM)).

By receiving image data 16 at frame rate conversion unit 20 and buffering image data 16 with image frame buffer 22, input timing of image data 16 can be decoupled from a timing requirement of display device 26. More specifically, since image data 16 for image frame 28 is received and stored by image frame buffer 22, image data 16 can be received as input at any rate. As such, the frame rate of image frame 28 can be converted to the timing requirement of display device 26. Thus, image data 16 for image frame 28 can be extracted from image frame buffer 22 at a frame rate of display device 26.

In one embodiment, image processing unit 24 includes a resolution adjustment unit 34 and a sub-frame generation unit 36. As described below, resolution adjustment unit 34 receives image data 16 for image frame 28 and adjusts a resolution of image data 16 for display on display device 26, and sub-frame generation unit 36 generates a plurality of image sub-frames 30 for image frame 28. More specifically, image processing unit 24 receives image data 16 for image frame 28 at an original resolution and processes image data 16 to increase, decrease, and/or leave unaltered the resolution of image data 16. Accordingly, with image processing unit 24, image display system 10 can receive and display image data 16 of varying resolutions.

Sub-frame generation unit 36 receives and processes image data 16 for image frame 28 to define a plurality of image sub-frames 30 for image frame 28. If resolution adjustment unit 34 has adjusted the resolution of image data 16, sub-frame generation unit 36 receives image data 16 at the adjusted resolution. The adjusted resolution of image data 16 may be increased, decreased, or the same as the original resolution of image data 16 for image frame 28. Sub-frame generation unit 36 generates image sub-frames 30 with a resolution which matches the resolution of display device 26. Image sub-frames 30 are each of an area equal to image frame 28. Sub-frames 30 each include a plurality of columns and a plurality of rows of individual pixels representing a subset of image data 16 of image 12, and have a resolution that matches the resolution of display device 26.

Each image sub-frame 30 includes a matrix or array of pixels for image frame 28. Image sub-frames 30 are spatially offset from each other such that each image sub-frame 30 includes different pixels and/or portions of pixels. As such, image sub-frames 30 are offset from each other by a vertical distance and/or a horizontal distance, as described below.

Display device 26 receives image sub-frames 30 from image processing unit 24 and sequentially displays image sub-frames 30 to create displayed image 14. More specifically, as image sub-frames 30 are spatially offset from each other, display device 26 displays image sub-frames 30 in different positions according to the spatial offset of image sub-frames 30, as described below. As such, display device 26 alternates between displaying image sub-frames 30 for image frame 28 to create displayed image 14. Accordingly, display device 26 displays an entire sub-frame 30 for image frame 28 at one time.

In one embodiment, display device 26 performs one cycle of displaying image sub-frames 30 for each image frame 28. Display device 26 displays image sub-frames 30 so as to be spatially and temporally offset from each other. In one embodiment, display device 26 optically steers image sub-frames 30 to create displayed image 14. As such, individual pixels of display device 26 are addressed to multiple locations.

In one embodiment, display device 26 includes an image shifter 38. Image shifter 38 spatially alters or offsets the position of image sub-frames 30 as displayed by display device 26. More specifically, image shifter 38 varies the position of display of image sub-frames 30, as described below, to produce displayed image 14.

In one embodiment, display device 26 includes a light modulator for modulation of incident light. The light modulator includes, for example, a plurality of micro-mirror devices arranged to form an array of micro-mirror devices. As such, each micro-mirror device constitutes one cell or pixel of display device 26. Display device 26 may form part of a display, projector, or other imaging system.

In one embodiment, image display system 10 includes a timing generator 40. Timing generator 40 communicates, for example, with frame rate conversion unit 20, image processing unit 24, including resolution adjustment unit 34 and sub-frame generation unit 36, and display device 26, including image shifter 38. As such, timing generator 40 synchronizes buffering and conversion of image data 16 to create image frame 28, processing of image frame 28 to adjust the resolution of image data 16 and generate image sub-frames 30, and positioning and displaying of image sub-frames 30 to produce displayed image 14. Accordingly, timing generator 40 controls timing of image display system 10 such that entire sub-frames of image 12 are temporally and spatially displayed by display device 26 as displayed image 14.

Figure 2C:
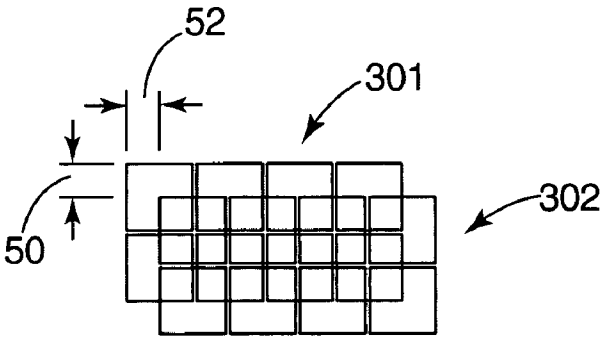
FIGS. 2A-2C are schematic diagrams illustrating the display of two sub-frames according to one embodiment of the present invention.
Figure 2B:
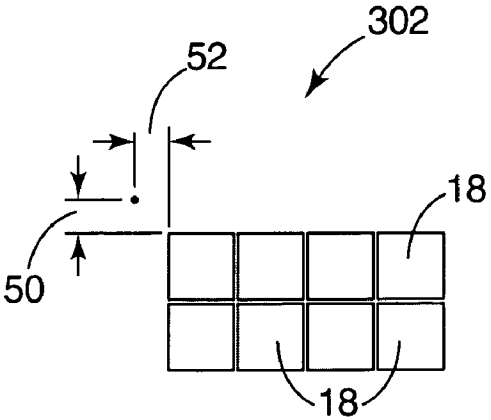
Figure 2A:
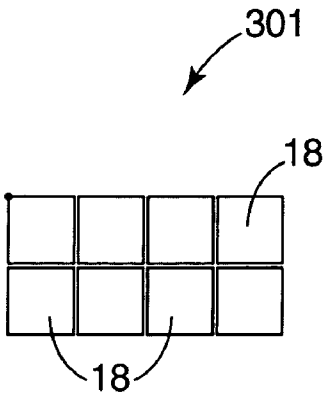

In one embodiment, as illustrated in FIGS. 2A and 2B, image processing unit 24 defines two image sub-frames 30 for image frame 28. More specifically, image processing unit 24 defines a first sub-frame 301 and a second sub-frame 302 for image frame 28. As such, first sub-frame 301 and second sub-frame 302 each include a plurality of columns and a plurality of rows of individual pixels 18 of image data 16. Thus, first sub-frame 301 and second sub-frame 302 each constitute an image data array or pixel matrix of a subset of image data 16.

In one embodiment, as illustrated in FIG. 2B, second sub-frame 302 is offset from first sub-frame 301 by a vertical distance 50 and a horizontal distance 52. As such, second sub-frame 302 is spatially offset from first sub-frame 301 by a predetermined distance. In one illustrative embodiment, vertical distance 50 and horizontal distance 52 are each approximately one-half of one pixel.

As illustrated in FIG. 2C, display device 26 alternates between displaying first sub-frame 301 in a first position and displaying second sub-frame 302 in a second position spatially offset from the first position. More specifically, display device 26 shifts display of second sub-frame 302 relative to display of first sub-frame 301 by vertical distance 50 and horizontal distance 52. As such, pixels of first sub-frame 301 overlap pixels of second sub-frame 302. In one embodiment, display device 26 performs one cycle of displaying first sub-frame 301 in the first position and displaying second sub-frame 302 in the second position for image frame 28. Thus, second sub-frame 302 is spatially and temporally displaced relative to first sub-frame 301. The display of two temporally and spatially shifted sub-frames in this manner is referred to herein as two-position processing.

In another embodiment, as illustrated in FIGS. 3A-3D, image processing unit 24 defines four image sub-frames 30 for image frame 28. More specifically, image processing unit 24 defines a first sub-frame 301, a second sub-frame 302, a third sub-frame 303, and a fourth sub-frame 304 for image frame 28. As such, first sub-frame 301, second sub-frame 302, third sub-frame 303, and fourth sub-frame 304 each include a plurality of columns and a plurality of rows of individual pixels 18 of image data 16.

Figure 3A:
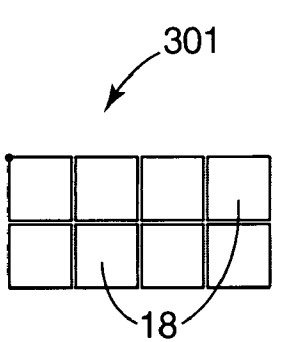
FIGS. 3A-3E are schematic diagrams illustrating the display of four sub-frames according to one embodiment of the present invention.
Figure 3B:
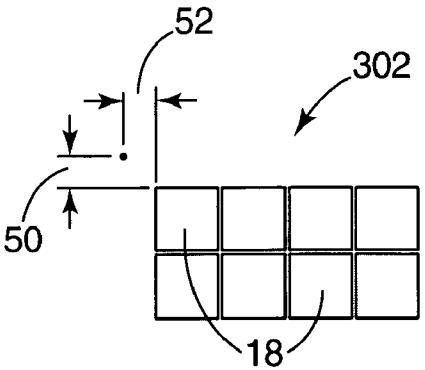
Figure 3C:
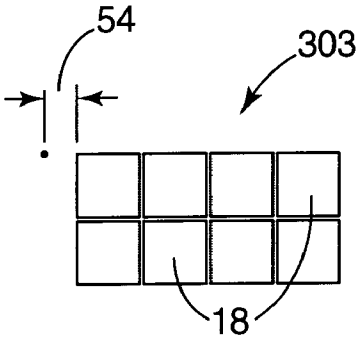
Figure 3D:
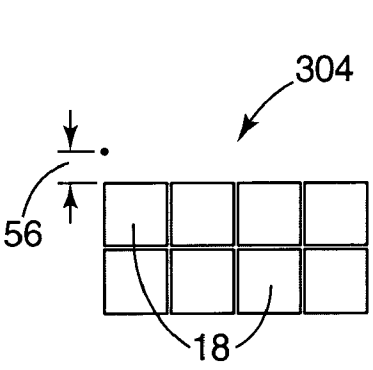

In one embodiment, as illustrated in FIGS. 3B-3D, second sub-frame 302 is offset from first sub-frame 301 by a vertical distance 50 and a horizontal distance 52, third sub-frame 303 is offset from first sub-frame 301 by a horizontal distance 54, and fourth sub-frame 304 is offset from first sub-frame 301 by a vertical distance 56. As such, second sub-frame 302, third sub-frame 303, and fourth sub-frame 304 are each spatially offset from each other and spatially offset from first sub-frame 301 by a predetermined distance. In one illustrative embodiment, vertical distance 50, horizontal distance 52, horizontal distance 54, and vertical distance 56 are each approximately one-half of one pixel.

Figure 3E:
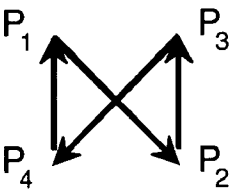

As illustrated schematically in FIG. 3E, display device 26 alternates between displaying first sub-frame 301 in a first position $P_1$, displaying second sub-frame 302 in a second position $P_2$ spatially offset from the first position, displaying third sub-frame 303 in a third position $P_3$ spatially offset from the first position, and displaying fourth sub-frame 304 in a fourth position $P_4$ spatially offset from the first position. More specifically, display device 26 shifts display of second sub-frame 302, third sub-frame 303, and fourth sub-frame 304 relative to first sub-frame 301 by the respective predetermined distance. As such, pixels of first sub-frame 301, second sub-frame 302, third sub-frame 303, and fourth sub-frame 304 overlap each other.

In one embodiment, display device 26 performs one cycle of displaying first sub-frame 301 in the first position, displaying second sub-frame 302 in the second position, displaying third sub-frame 303 in the third position, and displaying fourth sub-frame 304 in the fourth position for image frame 28. Thus, second sub-frame 302, third sub-frame 303, and fourth sub-frame 304 are spatially and temporally displayed relative to each other and relative to first sub-frame 301. The display of four temporally and spatially shifted sub-frames in this manner is referred to herein as four-position processing.

Figure 4A:
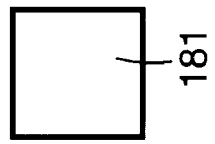
FIGS. 4A-4E are schematic diagrams illustrating the display of a pixel with an image display system according to one embodiment of the present invention.
Figure 4B:
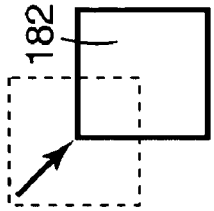
Figure 4C:
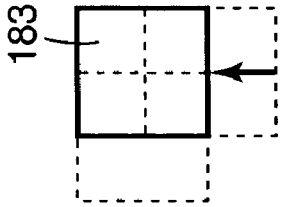
Figure 4D:
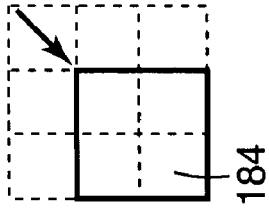
Figure 4E:
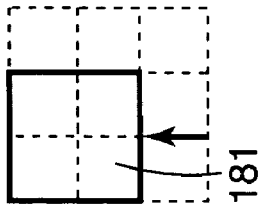

FIGS. 4A-4E illustrate one embodiment of completing one cycle of displaying a pixel 181 from first sub-frame 301 in the first position, displaying a pixel 182 from second sub-frame 302 in the second position, displaying a pixel 183 from third sub-frame 303 in the third position, and displaying a pixel 184 from fourth sub-frame 304 in the fourth position. More specifically, FIG. 4A illustrates display of pixel 181 from first sub-frame 301 in the first position, FIG. 4B illustrates display of pixel 182 from second sub-frame 302 in the second position (with the first position being illustrated by dashed lines), FIG. 4C illustrates display of pixel 183 from third sub-frame 303 in the third position (with the first position and the second position being illustrated by dashed lines), FIG. 4D illustrates display of pixel 184 from fourth sub-frame 304 in the fourth position (with the first position, the second position, and the third position being illustrated by dashed lines), and FIG. 4E illustrates display of pixel 181 from first sub-frame 301 in the first position (with the second position, the third position, and the fourth position being illustrated by dashed lines).

Sub-frame generation unit 36 (FIG. 1) generates sub-frames 30 based on image data in image frame 28. It will be understood by a person of ordinary skill in the art that functions performed by sub-frame generation unit 36 may be implemented in hardware, software, firmware, or any combination thereof. The implementation may be via a microprocessor, programmable logic device, or state machine. Components of the present invention may reside in software on one or more computer-readable mediums. The term computer-readable medium as used herein is defined to include any kind of memory, volatile or non-volatile, such as floppy disks, hard disks, CD-ROMs, flash memory, read-only memory (ROM), and random access memory.

In one form of the invention, sub-frames 30 have a lower resolution than image frame 28. Thus, sub-frames 30 are also referred to herein as low resolution images 30, and image frame 28 is also referred to herein as a high resolution image 28. It will be understood by persons of ordinary skill in the art that the terms low resolution and high resolution are used herein in a comparative fashion, and are not limited to any particular minimum or maximum number of pixels. Sub-frame generation unit 36 is configured to use any suitable algorithm to generate pixel values for sub-frames 30.

II. Array for Displaying Sub-Frames in a Display Device

In certain embodiments, display device 26 includes a pixel array that includes pixels arranged in rows and columns. The pixels are grouped into a first group of sets and a second group of sets where each set has a predefined number of pixels, e.g., four adjacent pixels, and each of the second group of sets is offset from each of the first group of sets. In response to receiving a first sub-frame 30A associated with image frame 28, display device 26 causes each sub-frame pixel value of image sub-frame 30A to be displayed by a set of pixels of the pixel array from the first group of sets. In response to receiving a second sub-frame 30B associated with image frame 28, display device 26 causes each sub-frame pixel value of image sub-frame 30B to be displayed by a set of pixels of the pixel array from the second group of sets. As a result, display device 26 displays sub-frames 30A and 30B at spatially offset positions.

As noted above, image shifter 38 may be configured to spatially alter or offset the position of image sub-frames 30A and 30B displayed by display device 26. As described herein below, the function of image shifter 38 may be performed electronically within display device 26 without the need to mechanically shift sub-frames 30A and 30B.

Figure 5:
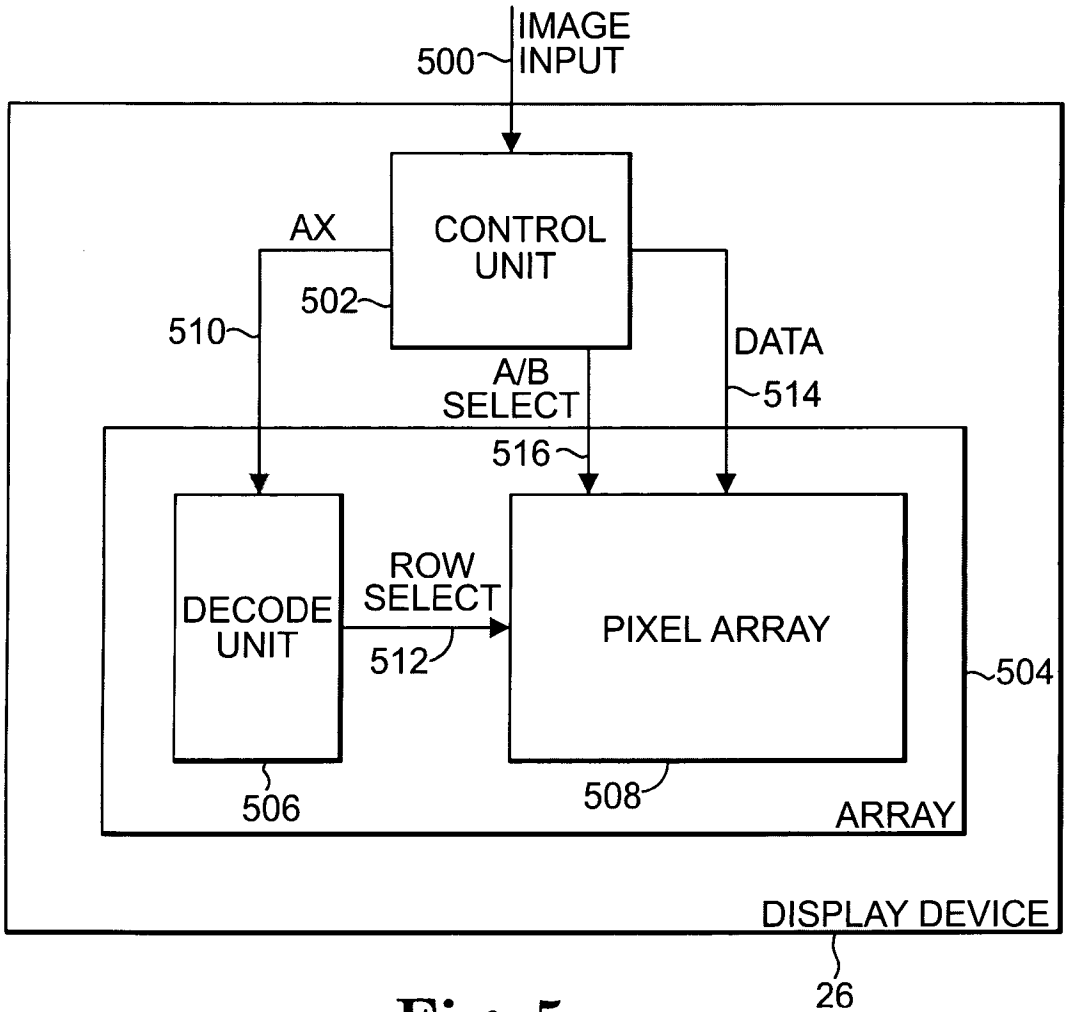
FIG. 5 is a block diagram illustrating a display device according to one embodiment of the present invention.

FIG. 5 is a block diagram illustrating one embodiment of display device 26. In the embodiment of FIG. 5, display device 26 may comprise a microdisplay, a spatial light modulator, a direct view digital display, or other suitable display. Display device 26 comprises a control unit 502 and an array 504.

Display device 26 receives sub-frames 30A and 30B using an image input signal 500 and causes sub-frames 30A and 30B to be displayed on a screen or other surface in response to image input signal 500 using control unit 502 and array 504. Control unit 502 receives sub-frames 30A and 30B using image input signal 500. Control unit 502 provides an address signal $A_X$, a data signal 514, and an A/B select signal 516 (also referred to as "set select signal 516") to array 504. Array 504 includes a decode unit 506 and a pixel array 508. Decode unit 506 receives the address signal $A_X$ from control unit 502 and provides n row select signals 512 to pixel array 508 where n is equal to the number of rows in pixel array 508 divided by two. Pixel array 508 receives row selector signals 512 from decode unit 506 and data signal 514 and A/B select signal 516 from control unit 502.

Figure 6:
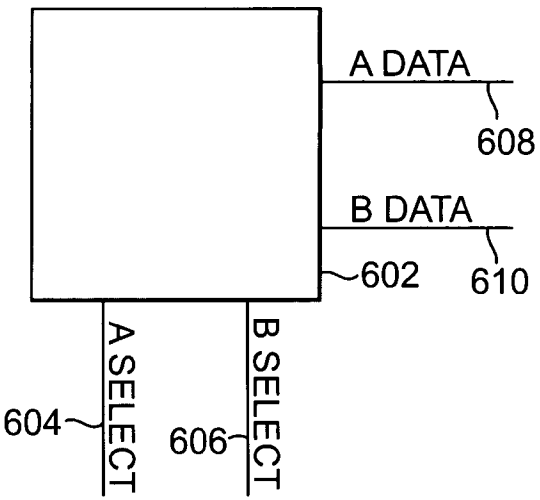
FIG. 6 is a block diagram illustrating a pixel according to one embodiment of the present invention.
Figure 7:
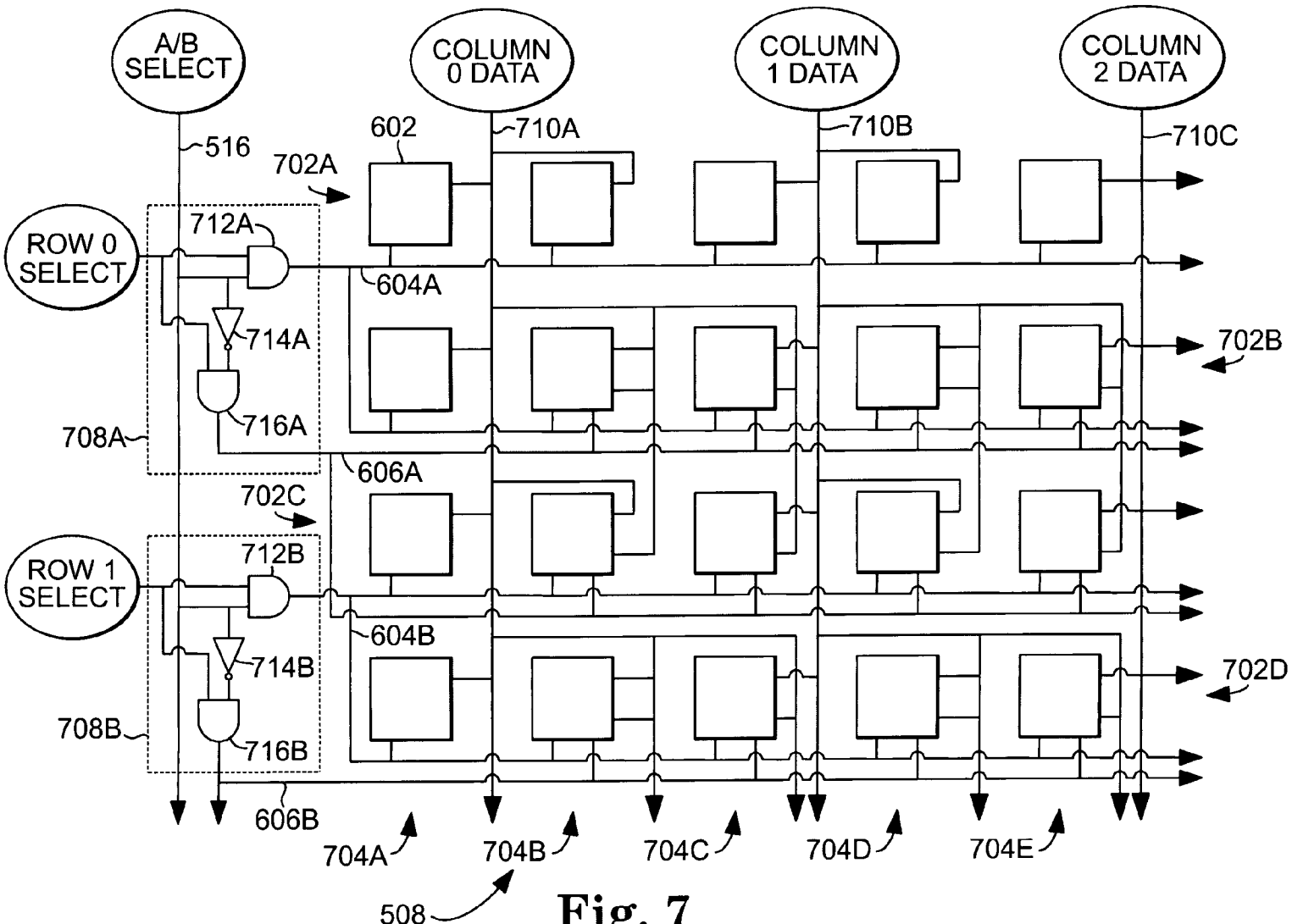
FIG. 7 is a schematic diagram illustrating a pixel array according to one embodiment of the present invention.

Pixel array 508 includes a plurality of pixels 602, shown in FIGS. 6 and 7, arranged in a plurality of rows and a plurality of columns. Pixels 602 are grouped into a first group of sets and a second group of sets where each set has a predefined number of pixels, e.g., four adjacent pixels, and each of the second group of sets is offset from each of the first group of sets such that the second group of sets covers a different area of pixel array 508 than the first group of sets.

Display device 26 displays sub-frame 30A by causing each sub-frame pixel value of sub-frame 30A to be displayed by a set of pixels 602 from the first group of sets. Display device 26 displays sub-frame 30B by causing each sub-frame pixel value of sub-frame 30B to be displayed by a set of pixels 602 from the second group of sets. As a result, display device 26 displays sub-frames 30A and 30B at spatially offset positions.

FIG. 6 is a block diagram illustrating one embodiment of a pixel 602 from pixel array 508. Pixel 602 displays a sub-frame pixel value from sub-frame 30A or 30B in response to an A select signal 604, a B select signal 606, an A data signal 608, and a B data signal 610. As will be described with reference to FIG. 7 below, pixel array 508 generates A select signal 604 and B select signal 606 in response to A/B select signal 516 and a row select signal 512 that corresponds to a row that includes pixel 602. Control unit 502 provides A data signal 608 and B data signal 610 to pixel 602 in response to image input signal 500. The values provided on A data signal 608 and B data signal 610 comprise sub-frame pixel values associated with sub-frames 30A and 30B, respectively.

In operation, pixel 602 displays, e.g., latches, a sub-frame pixel value of sub-frame 30A received from A data signal 608 in response to receiving A select signal 604. Similarly, pixel 602 displays, e.g., latches, the sub-frame pixel value of sub-frame 30B received from B data signal 610 in response to receiving B select signal 606.

FIG. 7 is a schematic diagram illustrating one embodiment of pixel array 508. In FIG. 7, pixel array 508 includes pixels 602 arranged in rows 702, e.g., rows 702A, 702B, 702C, and 702D, and columns 704, e.g., columns 704A, 704B, 704C, and 704D. Pixel array 508 also includes additional rows and columns of pixels 602 (not shown).

Pixel array 508 further includes a selector circuit 708, e.g., selector circuits 708A and 708B, for each pair of rows 702. Each selector circuit 708 controls the operation of pixels 602 in up to three rows 702. For example, selector circuit 708A controls the operation of pixels 602 in rows 702A, 702B, and 702C. Each selector circuit 708 includes an AND gate 712, an inverter 714, and an AND gate 716. Each AND gate 712 receives A/B select signal 516 and a row select signal 512 as inputs and outputs an A select signal 604 to pixels 602 in two rows 702, e.g., A select signal 604A is output to pixels 602 in rows 702A and 702B. Each inverter 704 receives A/B select signal 516 as an input and outputs an inverted A/B select signal. Each AND gate 716 receives a row select signal 512 and the inverted A/B select signal as an input and outputs a B select signal 606 to pixels 602 in two rows 702, e.g., B select signal 606A is output to pixels 602 in rows 702B and 702C.

Pixel array 508 receives a column data signal 710, e.g., column 0 data signal 710A, column 1 data signal 710B, and column 2 data signal 710C, for each pair of columns 704. Each column data signal 710 provides sub-frame pixel values to pixels 602 in up to three columns 704. For example, column data signal 710B provides sub-frame pixel values to pixels 602 in columns 704C, 704D, and 704E. Each column data signal 710 provides either the A data signal 608, the B data signal 610

Figure 8A:
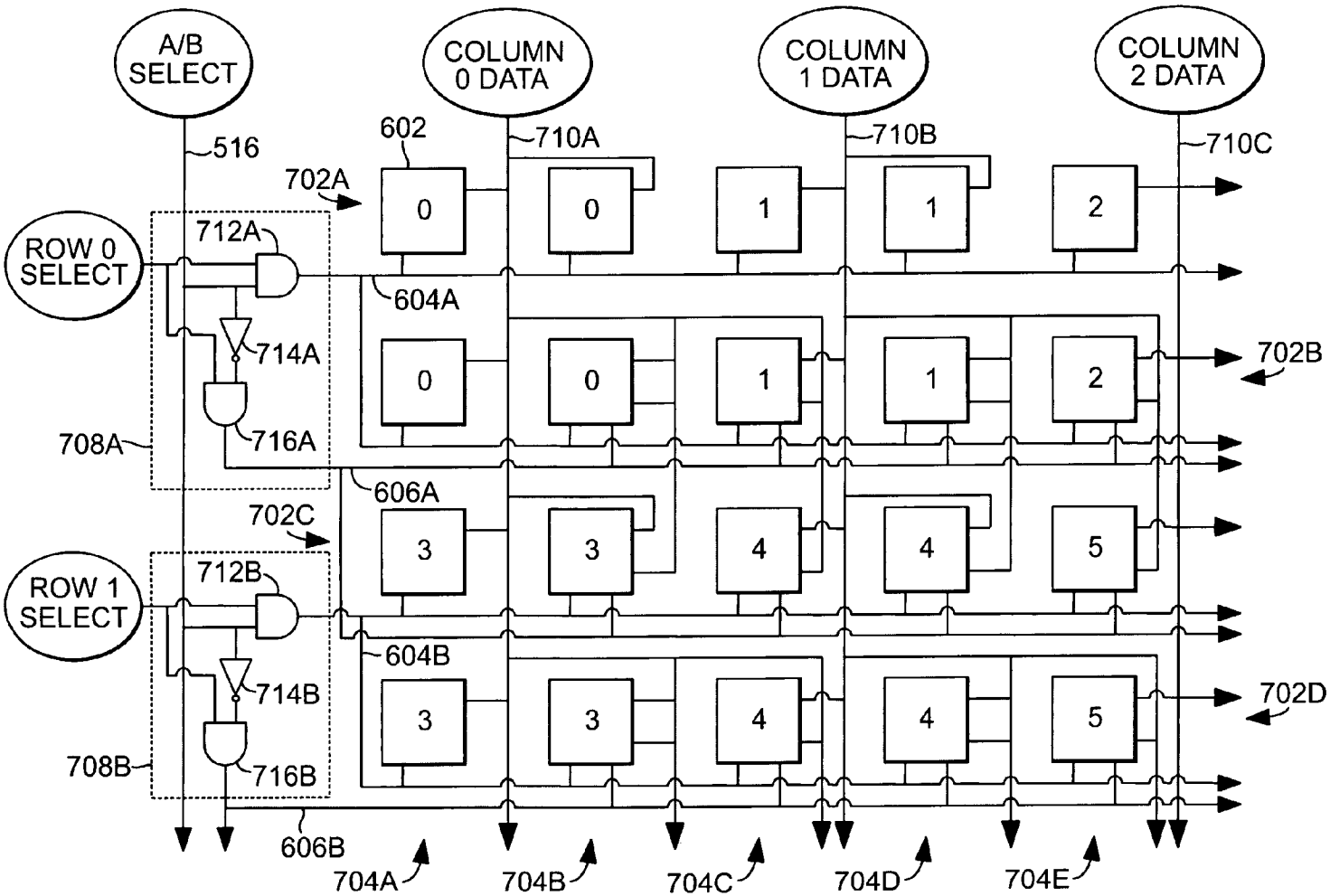
FIGS. 8A-8B are schematic diagrams illustrating example values in a pixel array according to one embodiment of the present invention.
Figure 8B:
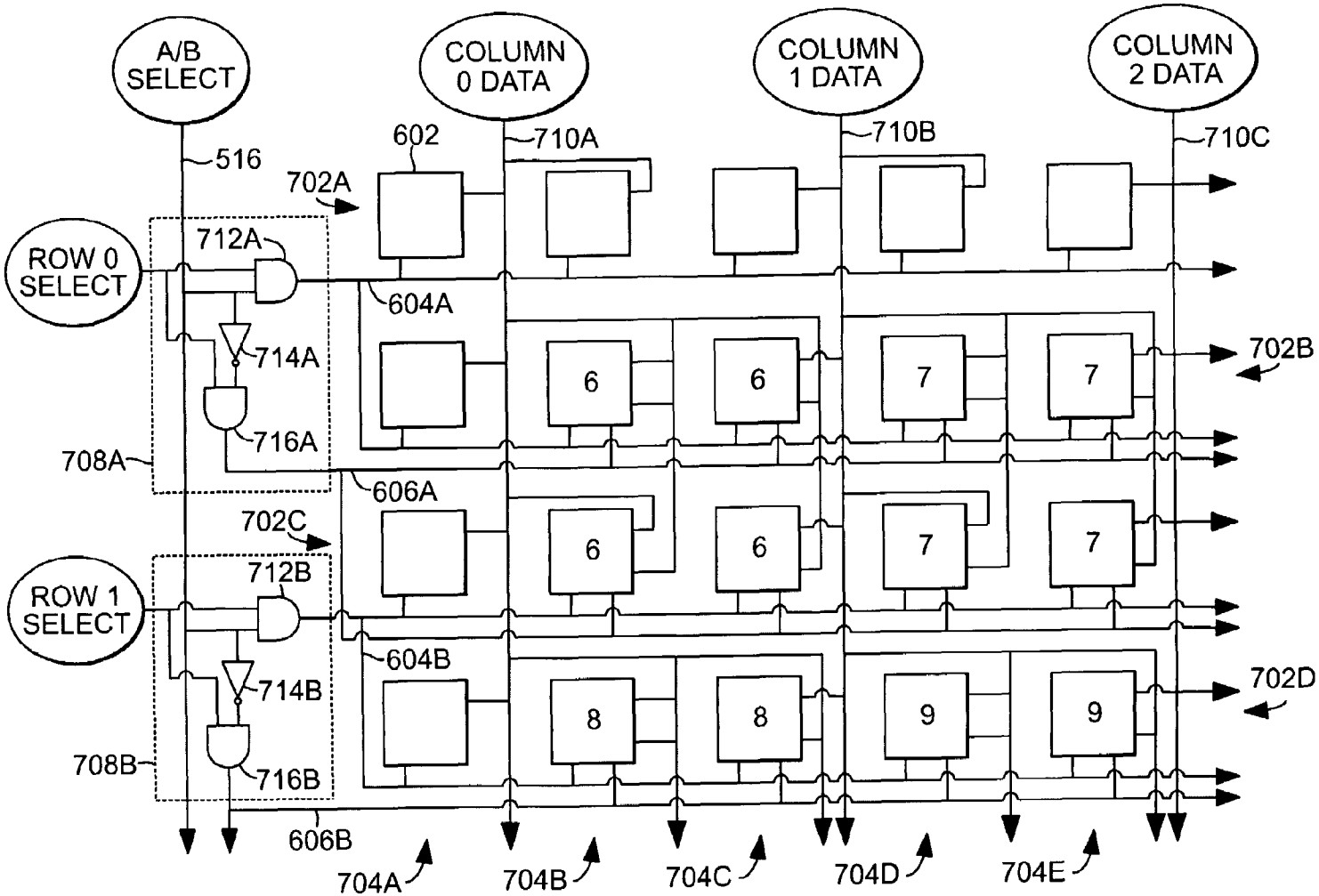

As noted above, display device 26 displays each sub-frame pixel value of sub-frame 30A using a set of pixels 602 from a first group of sets and displays each sub-frame pixel value of sub-frame 30B using a set of pixels 602 from a second group of sets. In the embodiment shown in FIG. 7, each of the sets in the second group is diagonally offset from one of the sets in the first group as illustrated in the examples in FIGS. 8A and 8B. FIG. 8A is a schematic diagram illustrating displaying sub-frame pixel values from sub-frame 30A in pixel array 508 during a first time period, and FIG. 8B is a schematic diagram illustrating displaying sub-frame pixel values from sub-frame 30B in pixel array 508 during a second time period that is either before or after the first time period.

In FIG. 8A, pixel array 508 displays sub-frame pixel values from sub-frame 30A during the first time period. To do so, selector circuits 708 in pixel array 508 generate A select signals 604 for each pair of rows 702 using row select signals 512 and A/B select signal 516. In response to the A select signals 604, sub-frame pixel values from sub-frame 30A are displayed in the first group of sets of pixels 602 using the A data signals 608 from column data signals 710. The sub-frame pixel values are displayed sequentially two rows at a time in response to corresponding row select signals 512.

In the example of FIG. 8A, a sub-frame pixel value of "0" is displayed by the set of four pixels defined by rows 702A and 702B and columns 704A and 704B in response to A select signal 604A and column data signal 710A. A sub-frame pixel value of "1" is displayed by the set of four pixels defined by rows 702A and 702B and columns 704C and 704D in response to A select signal 604A and column data signal 710B. A sub-frame pixel value of "2" is displayed by the set of four pixels defined by rows 702A and 702B, column 704E, and a next column 704 (not shown) in response to A select signal 604A and column data signal 710C.

A sub-frame pixel value of "3" is displayed by the set of four pixels defined by rows 702C and 702D and columns 704A and 704B in response to A select signal 604B and column data signal 710A. A sub-frame pixel value of "4" is displayed by the set of four pixels defined by rows 702C and 702D and columns 704C and 704D in response to A select signal 604B and column data signal 710B. A sub-frame pixel value of "5" is displayed by the set of four pixels defined by rows 702C and 702D, column 704E, and a next column 704 (not shown) in response to A select signal 604B and column data signal 710C.

In FIG. 8B, pixel array 508 displays sub-frame pixel values from sub-frame 30B during the second time period. To do so, selector circuits 708 in pixel array 508 generate B select signals 606 for each pair of rows 702 using row select signals 512 and A/B select signal 516. In response to the B select signals 606, sub-frame pixel values from sub-frame 30B are displayed in the second group of sets of pixels 602 using the B data signals 610 from column data signals 710. The sub-frame pixel values are displayed sequentially two rows at a time in response to corresponding row select signals 512.

In the example of FIG. 8B, a sub-frame pixel value of "6" is displayed by the set of four pixels defined by rows 702B and 702C and columns 704B and 704C in response to B select signal 606A and column data signal 710A. A sub-frame pixel value of "7" is displayed by the set of four pixels defined by rows 702B and 702C and columns 704D and 704E in response to B select signal 606A and column data signal 710B.

A sub-frame pixel value of "8" is displayed by the set of four pixels defined by row 702D, a next row 702 (not shown), and columns 704B and 704C in response to B select signal 606B and column data signal 710A. A sub-frame pixel value of "9" is displayed by the set of four pixels defined by row 702D, a next row 702 (not shown), and columns 704D and 704E in response to B select signal 606B and column data signal 710B.

In the embodiment shown in FIGS. 7-8B, the offset between each set of pixels 602 in the first group and each set of pixels 602 in the second group is one diagonal pixel. As a result, sub-frame pixel values from sub-frame 30B are not displayed in row 702A or column 704A and the connection for B data signal 610 may be omitted for each of pixels 602 in row 702A and column 704A.

In other embodiments, other offsets may be used between each set of pixels 602 in the first group and each set of pixels 602 in the second group. In addition, numbers of pixels 602 other than those shown in the examples of FIGS. 6-8B may be used in each of the set of pixels that correspond to sub-frame pixel values. In these embodiments, appropriate connections may be made for each pixel 602, each selector circuit 708, and each column data signal 710.

In other embodiments, the sets of pixels 602 in each group may comprise other numbers or arrangements of pixels.

In the embodiment shown in FIG. 7, each pixel 602 represents all of the color planes (e.g., red, green, and blue color planes) of display device 26. In this embodiment, display device 26 displays sub-frames 30A and 30B such that all color planes are aligned.

In other embodiments, the set of pixels 602 shown in FIG. 7 represents only one of the color planes of display device 26. In these embodiments, pixel array 508 includes another set of pixels 602 (not shown), another set of selector circuits 708 (not shown), and another set of column data signals 710 (not shown) for each additional color plane. Display device 26 displays sub-frames 30A and 30B such that color planes within each sub-frame are offset. For example, display device 26 may display the sub-frame pixel values of the red color plane of sub-frame 30A in the relative positions shown in FIG. 8A, i.e., the "A" position, and the sub-frame pixel values of the blue and green color planes of sub-frame 30A in the relative positions shown in FIG. 8B, i.e., the "B" position, such that the red color plane is offset from the blue and green color planes. Similarly, display device 26 may display the sub-frame pixel values of the red color plane of sub-frame 30B in the relative positions shown in FIG. 8B, i.e., the "B" position, and the sub-frame pixel values of the blue and green color planes of sub-frame 30B in the relative positions shown in FIG. 8A, i.e., the "A" position, such that the red color plane is again offset from the blue and green color planes. By offsetting the color planes, the amount of flicker in displayed image 14 is reduced. In addition, resolution may be increased and spatial artifacts may be reduced.

To offset the color planes, modifications in pixel array 508 may be made to A/B select signal 516, selector circuits 708, or the connections between selector circuits 708 and pixels 602 for the offset color planes. For example, A/B select signal 516 may be inverted prior to being provided to selector circuits 708 for the blue and green color planes in the example described in the previous paragraph. Other modifications may also allow the color planes to be offset within pixel array 508.

In the embodiment described above, display device 26 may include one-fourth of the number of pixel drivers when compared to a display device where each individual pixel may be separately addressed.

In other embodiments, pixels 602 in pixel array 508 may be arranged in a diagonal pixel array. In these embodiments, pixel array 508 may comprise twice as many pixels 602 when compared to the embodiment shown in FIG. 7. Accordingly, pixel array 508 also comprises twice as many drivers and twice as many selector circuits 708 when compared to the embodiment shown in FIG. 7. In addition, sub-frames 30A and 30B may comprise twice as many sub-frame pixel values when compared to the number of sub-frame pixel values of the sub-frames 30A and 30B used in the embodiment shown in FIG. 7.

In other embodiments, pixel array 508 may be modified to display n sub-frames where each sub-frame is displayed using a different set of pixels 602 in pixel array 508. In these embodiments, select signals similar to A/B select signal 516 may be added to allow each of the sets of pixels 602 to be selected, and appropriate connections may be made for each pixel 602, each selector circuit 708, and each column data signal 710.

In a further embodiment, a display array is addressed such that blocks of four pixels are selected at a time and all four pixels in a block receive the same data. By doing so, bandwidth may be reduced by a factor of four, but resolution may also be reduced. To enhance the resolution, two sub-frames of blocky data are sent to the array for each real frame of image data. The second sub-frame is offset from the first sub-frame by one pixel. By using two sub-frames, bandwidth is reduced by a factor of two, i.e., one-fourth of the data times two sub-frame equals approximately one-half of the data.

Although specific embodiments have been illustrated and described herein for purposes of description of the preferred embodiment, it will be appreciated by those of ordinary skill in the art that a wide variety of alternate and/or equivalent implementations may be substituted for the specific embodiments shown and described without departing from the scope of the present invention. Those with skill in the mechanical, electromechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A display device for displaying an image using a first sub-frame and a second sub-frame, the display device comprising:

an array having a set of pixels; and a control unit configured to cause a first subset of the set of pixels to display the first sub-frame during a time period and a second subset of the set of pixels to display the second sub-frame subsequent to the time period;

wherein each of the first and the second subsets of the set of pixels includes a third subset of the set of pixels, wherein the first subset of the set of pixels includes a fourth subset of the set of pixels, and wherein the second subset of the set of pixels does not include the fourth subset of the set of pixels.

2. The display device of claim 1 wherein the first subset of the set of pixels comprises a first plurality of groups of four adjacent pixels, and wherein the second subset of the set of pixels comprises a second plurality of groups of four adjacent pixels.

3. The display device of claim 2 wherein each of the second plurality of groups of four adjacent pixels is offset from a respective one the first plurality of groups of four adjacent pixels.

4. The display device of claim 3 wherein each of the second plurality of groups of four adjacent pixels is diagonally offset from a respective one the first plurality of groups of four adjacent pixels by a distance of one pixel.

5. The display device of claim 1 wherein the control unit is configured to cause the array to display the first sub-frame by providing a first value of a select signal to the array during the time period, and wherein the control unit is configured to cause the array to display the second sub-frame by providing a second value of a select signal to the array subsequent to the time period.

6. The display device of claim 5 wherein the array comprises a plurality of selector circuits configured to receive the select signal, wherein each of the plurality of selector circuits is configured to provide a first signal to the first subset of the set of pixels in response to receiving the first value of the select signal to display the first sub-frame, and wherein each of the plurality of selector circuits is configured to provide a second signal to the second subset of the set of pixels in response to receiving the second value of the select signal to display the second sub-frame.

7. The display device of claim 1 wherein the first subset of the set of pixels comprises a first plurality of rows, and wherein the second subset of the set of pixels comprises a second plurality of rows that includes a subset of the first plurality of rows.

8. The display device of claim 1 wherein the first subset of the set pixels comprises a first plurality of columns, and wherein the second subset of the set pixels comprises a second plurality of columns that includes a subset of the first plurality of columns.

9. The display device of claim 1 wherein the first and second subsets of the set pixels comprise a diagonal pixel array.

10. The display device of claim 1 wherein the control unit is configured to cause the array to display a first color plane of the first sub-frame using the first subset of the set of pixels and the first color plane of the second sub-frame using the second subset of the set of pixels, wherein the control unit is configured to cause a fifth subset of the set of pixels to display a second color plane of the first sub-frame during the time period and a sixth subset of the set of pixels to display the second color plane of the second sub-frame subsequent to the time period;

wherein each of the fifth and the sixth subsets of the set of pixels includes a seventh subset of the set of pixels, wherein the fifth subset of the set of pixels includes an eighth subset of the set of pixels, and wherein the sixth subset of the set of pixels does not include the eighth subset of the set of pixels.

11. The display device of claim 10 wherein the first subset of the set of pixels is aligned with the fifth subset of the set of pixels, and wherein the second subset of the set of pixels is aligned with the sixth subset of the set of pixels.

12. The display device of claim 10 wherein the first subset of the set of pixels is aligned with the sixth subset of the set of pixels, and wherein the second subset of the set of pixels is aligned with the fifth subset of the set of pixels.

13. A method of displaying an image in an array using a first sub-frame and a second sub-frame, the method comprising:

displaying the first sub-frame in first and second subsets of a set of pixels of the array at a first time; and displaying the second sub-frame in at least the second subset of the set of pixels of the array but not the first subset of the set of pixels at a second time that is subsequent to the first time.

14. The method of claim 13 further comprising:

generating a first signal configured to select the first and the second subsets of the set of pixels at the first time; and generating a second signal configured to select the second subset of the set of pixels but not the first subset of the set of pixels at the second time.

15. The method of claim 13 further comprising:

providing a first plurality of sub-frame pixel values from the first sub-frame to the first and the second subsets of the set pixels at the first time; and providing a second plurality of sub-frame pixel values from the second sub-frame to the second subset of the set of pixels but not the first subset of the set of pixels at the second time.

16. The method of claim 13 wherein the first and the second subsets of the set of pixels comprise a first plurality of rows, and wherein the second subset of the set of pixels comprise a second plurality of rows that overlap the first plurality of rows.

17. The method of claim 13 wherein the first and the second subsets of the set of pixels comprises a first plurality of columns, and wherein the second subset of the set of pixels comprises a second plurality of columns that overlap the first plurality of columns.

18. The method of claim 13 wherein the first and the second subsets of the set of pixels comprise a diagonal pixel array.

19. The method of claim 13 wherein the first and the second subsets of the set of pixels comprises a first plurality of groups of four adjacent pixels, and wherein the second subset of the set of pixels comprises a second plurality of groups of four adjacent pixels.

20. The method of claim 19 wherein the second plurality of groups of four adjacent pixels is offset from the first plurality of groups of four adjacent pixels.

21. The method of claim 20 wherein the second plurality of groups of four adjacent pixels is diagonally offset from the first plurality of groups of four adjacent pixels by a distance of one pixel.

22. An array comprising:

a set of pixels arranged in a set of rows; and a set of selector circuits;

wherein the set of selector circuits is configured to provide a first set of data select signals to a first subset of the set of rows to cause a first sub-frame to be displayed by the first subset of the set of rows, wherein the set of selector circuits is configured to provide a second set of data select signals to a second subset of the set of rows to cause a second sub-frame to be displayed by the second subset of the set of rows, and wherein the second subset of the set of rows that includes at least one row from the first subset of the set of rows but does not include all of the rows from the first subset of the set of rows.

23. The array of claim 22 wherein the set of selector circuits is configured to provide the first set of data select signals to the first subset of the set of rows in response to receiving a first value of a set select signal, and wherein the set of selector circuits is configured to provide the second set of data select signals to the second subset of the set of rows in response to receiving a second value of a set select signal.

24. The array of claim 23 wherein the set of pixels is arranged in a set of columns configured to receive a set of column data signals.

25. The array of claim 24 wherein the first set of data select signals and the set of column data signals are configured to cause the first sub-frame to be displayed by the first subset of the set of rows and a first subset of the set of columns, wherein the second set of data select signals and the set of column data signals are configured to cause the second sub-frame to be displayed by the second subset of the set of rows and a second subset of the set of columns, and wherein the second subset of the set of columns that includes at least one column from the first subset of the set of columns but does not include all of the columns from the first subset of the set of columns.

26. A system for displaying an image in an array having a set of pixels using a first sub-frame having a first set of sub-frame pixel values and a second sub-frame having a second set of sub-frame pixel values, the system comprising:

means for receiving an address, the first set of sub-frame pixel values, the second set of sub-frame pixel values, and a select signal;

means for providing the first set of sub-frame pixel values to first and second subsets of the set of pixels for display using the address in response to a value of the select signal being associated with the first sub-frame; and means for providing the second set of sub-frame pixel values to the second subset of the set of pixels but not the first subset of the set of pixels for display using the address in response to the value of the select signal being associated with the second sub-frame.

27. The system of claim 26 further comprising:

means for generating the select signal.

28. The system of claim 26 wherein the first and the second subsets of the set of pixels comprises a first set of groups of four adjacent pixels from the set of pixels, and wherein the second subset of the set of pixels comprises a second set of groups of four adjacent pixels from the set of pixels.

29. The system of claim 28 wherein each of the second set of groups of four adjacent pixels is offset from each of the first set of groups of four adjacent pixels.

30. The system of claim 28 wherein each of the second set of groups of four adjacent pixels is diagonally offset from one of the first set of groups of four adjacent pixels by one pixel.

* * * * *